United States Patent [19]

Bridge

[11] Patent Number: 4,858,544

[45] Date of Patent: Aug. 22, 1989

[54] METHOD OF HAND-FORMING NEEDLEWORK PATTERNS

[76] Inventor: Corinne M. Bridge, 4480 E. Patricia Dr., Clarence, N.Y. 14031

[21] Appl. No.: 328,806

[22] Filed: Mar. 24, 1989

Related U.S. Application Data

[63] Continuation of Ser. No. 74,982, Jul. 17, 1987, abandoned.

[51] Int. Cl.[4] ..... D05B 93/00; D05C 1/08

[52] U.S. Cl. ..... 112/266.1; 112/439

[58] Field of Search ..... 112/266.1, 437, 439; 139/383, 416

[56] References Cited

U.S. PATENT DOCUMENTS 4,075,962 2/1978 Mabry ..... 112/266.1 X 4,530,665 7/1985 Colonel ..... 112/266.1 X

OTHER PUBLICATIONS

Reader's Digest Complete Guide to Needlework, © 1979, pp. 8, 9, 46 and 78.

*Primary Examiner*—Werner H. Schroeder

*Assistant Examiner*—Jeanette E. Chapman

*Attorney, Agent, or Firm*—Charles S. McGuire

[57] ABSTRACT

A method of hand-forming needlework patterns in a woven base fabric of the type having spaced, orthogonal thread groups, each including floating threads, some or all of which are removed from the base fabric to form additional openings, cooperating with those originally present in the base fabric, providing rows and columns of spaced openings. A needle threaded with a pattern thread is passed, and the thread drawn, alternately upwardly and downwardly through selected ones of the openings in a single row, and thereafter in additional rows, parallel to the first row, to form a complete design.

10 Claims, 2 Drawing Sheets

METHOD OF HAND-FORMING NEEDLEWORK PATTERNS

REFERENCE TO RELATED APPLICATION

This application is a continuation of copending application Ser. No. 74,982 filed July 17, 1987, now abandoned.

BACKGROUND OF THE INVENTION

The present invention relates to needlework methods and, more particularly, to novel methods of hand-forming needlework patterns in a specific type of woven base fabric.

Hand-produced needlework items wherein a pattern or design is produced on a base fabric by one or more threads drawn by a needle through a base fabric have been popular for centuries. Although the vast majority of such items are now mass produced by automated machinery, there is still a demand for handmade needlework items on a commercial scale, as well as for new designs and techniques which may be practised by amateurs as hobbies and crafts. Some of the most popular needleworking techniques in present use, although they have been well known for a great many years, are needlepoint, crewel embroidery, and counted cross-stitch.

Among the many types of woven fabrics which are commerically available are those including what are known as floating threads, or simply "floats." These are threads which pass over and under entire groups of orthogonal threads without being woven in tightly engaged relation therewith. The floats are interspersed with more tightly woven threads extending in the same direction, and are often employed in pairs, known in weaving as "double floats." A commercially available type of such fabric is commonly known as aida cloth, and is characterized by having both warp and weft threads arranged in spaced groups; double floats in each group pass over and under successive groups of orthogonal threads without being interwoven with the individual threads thereof.

SUMMARY OF THE INVENTION

The present invention is directed to novel techniques of manual needlework employing a base fabric of aida cloth or similar woven fabric including double or single floating threads. As an initial step, some or all of the floats are removed from the base fabric to provide an area where the pattern is to be formed which has successive rows of openings separated only by the individual threads, which remain after removal of the floats, extending across the fabric in one direction. In the orthogonal direction, successive columns of openings are separated by the width of each entire spaced group of threads.

After preparation of the base fabric, the design or pattern is formed by threading a needle with a pattern thread, such as pearl cotton or embroidery floss. Normally, the pattern threads will be of a different color than the base fabric so that the pattern will contrast sharply with the background, but since the pattern threads protrude noticeably from the fabric surface, pattern threads of the same color as the background fabric may be used. The needle is inserted and the thread drawn through one of the holes in the fabric, from back to front, leaving an end portion of the thread on the back side of the fabric. The needle is then inserted through another hole in the same row as the first, from front to back, and the pattern thread is drawn therethrough. This is continued, with the needle and pattern thread being drawn through the fabric alternately in opposite directions between front and back, through holes which are successive or spaced by a predetermined number of intervening holes according to the design to be formed.

When the first row has been completed, the thread is cut, leaving an end portion extending from the fabric at the end, as at the beginning of the row. The process is repeated in another row of holes in the base fabric, which may be immediately adjacent to or spaced from the first row by one or more columns of holes, the needle being re-threaded with additional pattern thread when required. By following a predetermined pattern, laid out by counting the number of holes between each successive pass of the needle through the base fabric, a design is formed by the pattern thread on the surface of the base fabric. Additional refinements of the technique will be found in the following detailed description.

The principal object of the invention is to provide a novel method of hand-forming designs on woven fabric by needlework techniques which is relatively quickly and easily learned by amateurs, but is also interesting and attractive in rendition.

Another object is to provide a needleworking method which uses readily available supplies, is entirely portable and requires no fabric supports such as hoops or frames.

Other objects will in part be obvious and will in part appear hereinafter.

DETAILED DESCRIPTION

Figure 1:
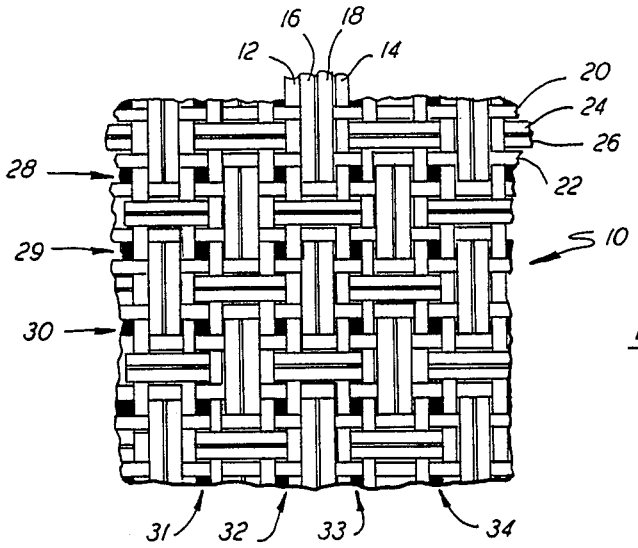
FIG. 1 is an enlarged, front view of a section of base fabric of the type with which the present invention is practised in a commercially available form of such fabric.

Referring now to the drawings, the needlework method of the invention is performed on a base fabric denoted generally throughout the several views by the reference numeral 10. In all cases, the needlework method requires a woven base fabric of the type having so-called floating threads or floats included in groups of threads extending in orthogonal directions and spaced from one another. In one type of such fabric, known as aida cloth and available from a number of manufacturers, each group of threads includes two outer threads with two floating threads therebetween, and is the type of fabric used to illustrate the present invention.

The needlework method may also be practised with base fabrics having single float threads, examples of which are those sold under the trademarks Klostern and Goldau, these being 7 and 6 count fabrics, respectively. It is, however, important to note that the base fabric must be of the type in which the floats are passed entirely through the fabric and around all threads of orthogonal groups, thus being accessible on both sides of the fabric. Commercially available fabrics having floats accessible, i.e., passing over an entire orthogonal thread group, on one side only, such as that commonly termed huck fabric and available from a number of manufacturers, are not suitable for use in the present invention.

Fabric 10 is shown in FIG. 1 in the as-manufactured form. The threads which are oriented vertically and horizontally in the illustration will be referred to for convenience as the warp and weft threads, respectively, to use the common terms for woven fabric. It will be noted that the weave is symmetrical whether viewed from the warp or weft direction so that, in the case of this particular fabric, orientation is of no consequence. Both the warp and weft threads are arranged in spaced groups of four, parallel threads in laterally adjoining, side-by-side relation. Although illustrated for convenience as single filament, it will be understood that each thread will normally be formed of two or more twisted strands of fibers, preferably cotton or other natural fiber.

Warp threads 12 and 14 are the outer threads of each group, and threads 16 and 18 are the inner threads. Likewise, threads 20 and 22 are the outer, and threads 24 and 26 are the inner threads of each group of weft threads. The weave is such that outer warp threads 12 and 14 pass under outer weft threads 20 and 22 and over inner threads 24 and 26 of alternating groups of weft threads, and oppositely for the intervening groups, i.e., over the outer and under the inner threads. Inner warp threads 16 and 18, on the other hand, pass over all four weft threads of one group and under all four threads of the next group. Since they are not woven through the individual threads of any weft group, the inner threads of each warp group are referred to as floating threads and, being employed in pairs, are called double floats.

The weave is the same in the orthogonal direction. That is, outer weft threads 20 and 22 pass over outer threads 12 and 14, and under inner threads 16 and 18, of alternating warp groups and oppositely for the other groups. Also, inner weft threads 24 and 26 pass over and under all four threads of each successive warp group, and are thus also considered double floats. Since there is an equal number of threads (four) in both the warp and weft groups, all thread groups are of substantially the same width. Also, the thread groups in both directions are spaced from adjacent groups by substantially the same distance, whereby an opening appears in fabric 10 at locations where the spaces between warp and weft thread groups overlap, i.e., in the common spaces between warp and weft thread groups. The openings are thus arranged in evenly spaced rows and columns, and the openings of each row and column are evenly spaced from one another. This gives the fabric the appearance of being composed of small squares with an opening at each corner of each square. The horizontal rows of openings are indicated by reference numerals 28, 29 and 30, and the vertical columns by reference numerals 31, 32, 33 and 34. The openings are darkened for greater clarity of illustration.

Figure 2:
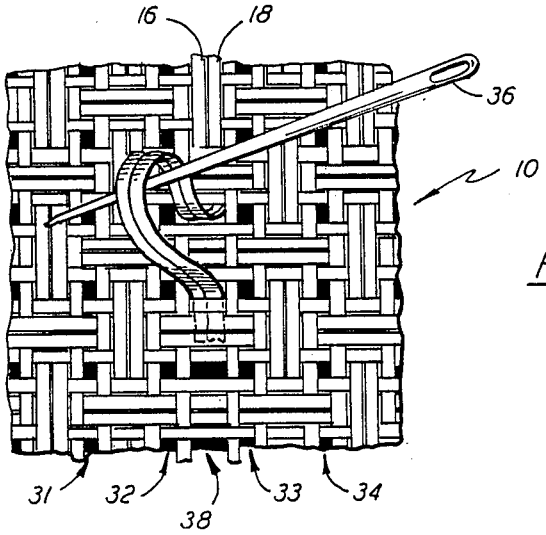
FIG. 2 is an enlarged, front view of the fabric of FIG. 1, shown with certain of the threads being removed as an initial step in the needlework method of the invention.

According to the needlework method of the present invention, certain pairs of float threads are removed, preferably by the "pick" method of inserting a needle point under both float threads of a pair and pulling one end thereof through the fabric. As illustrated in FIG. 2, float threads 16 and 18 are being removed from fabric 10 by needle 36, thereby forming another vertical column of openings, indicated by reference numeral 38 and positioned between columns 32 and 33. Since fabric 10 is of symmetrical weave in the warp and weft directions, float threads may be removed in either the vertical or horizontal direction.

Figure 3:
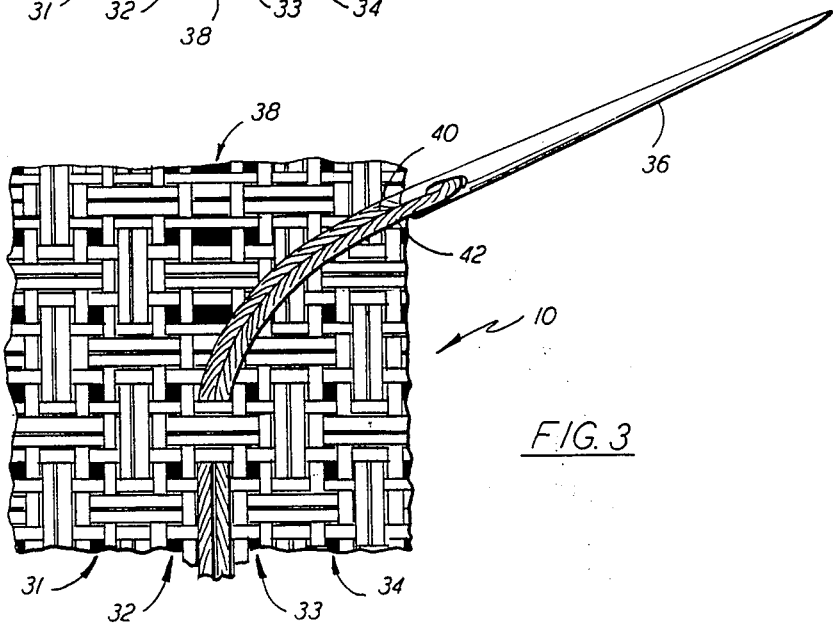
FIG. 3 is a front view of the fabric of FIGS. 1 and 2, shown with certain threads removed and a needle passing through selected locations thereon to draw a pattern thread through the fabric.

Fabric 10 is shown in FIG. 3 with float threads 16 and 18 removed, thus forming three successive vertical columns of openings, 32, 38 and 33, each separated by only a single warp thread. The number of thread groups from which the floats are removed is dependent upon the predetermined design to be formed on fabric 10. Needle 36 is threaded (either before or after removing the float threads) with what is termed a pattern thread to be worked into the weave of fabric 10. The pattern thread may be formed of either a single or a double strand, being illustrated as two strands 40 and 42. It is preferred, although not critical, that two strands of embroidery floss (e.g., #6 DMC) be used as the pattern thread when the base fabric is 14 or 18 count aida cloth, and a single strand of pearl cotton thread (#5 DMC) for 11 count aida cloth, and two strands of pearl cotton on 6 and 7 count fabric. One strand of #8 pearl cotton may be substituted for two strands of embroidery floss on 14 and 18 count fabric.

The predetermined pattern will normally be formed in accordance with a chart indicating the openings in the base fabric through which the pattern thread is to be drawn. With the side of the base fabric which will bear the front side of the pattern facing upward, the first pass of the needle through the fabric is from the lower to the upper side, preferably in an opening of an outer (i.e., upper or lower, right or left) row of openings in which the pattern will be formed. The pattern thread is not knotted at the end, but instead a generous length (e.g., one to two inches) of thread is left extending from, i.e., is not drawn through, the base fabric.

The needle is then passed downwardly through another opening in the same row, spaced from the first opening through which the needle was passed by a distance (i.e., by a number of intervening openings, if any) dictated by the predetermined design, normally indicated on a previously prepared chart of the design. The passing of the needle alternately in opposite directions, upwardly and downwardly, through the base fabric is continued until the first row of the design is completed. Preferably, all remaining thread is drawn completely through the fabric with each pas of the needle, as opposed to the use of "running" stitches normally used in quilting and some other forms of hand needlework.

In practising the needlework method of the invention, a number of details are preferably observed, in addition to those already mentioned. For example, the base fabric should be pre-shrunk before stitching. Also, the pattern threads should be as smooth as possible, which is enhanced by drawing each thread once or twice through a folded, damp sponge, holding them taut for a few seconds and laying flat or hung to dry. Strands of embroidery floss, but not pearl cotton, should be individually separated before being drawn through the damp sponge. The appearance of the completed design may also be enhanced by keeping the pattern threads parallel and untwisted by passing needle 36 between strands 40 and 42 as it is placed through the opening in fabric 10, as shown in FIG. 4.

When the portion of the pattern formed in the first row or column of openings is completed, the thread is cut off, again leaving an inch or two of thread extending from the fabric. If necessary the needle is then threaded with another length of pattern thread, and the next row in the design is formed, normally in the row of openings immediately adjacent the first completed row, as dictated by the predetermined design. This continues until the design is completed, an example of a finished design being shown in FIG. 5. Excess pattern thread at the end of each row, and excess base fabric around the design, if any, may then be trimmed, and edges of the base fabric may be fringed or hemmed, if desired.

Figure 4:
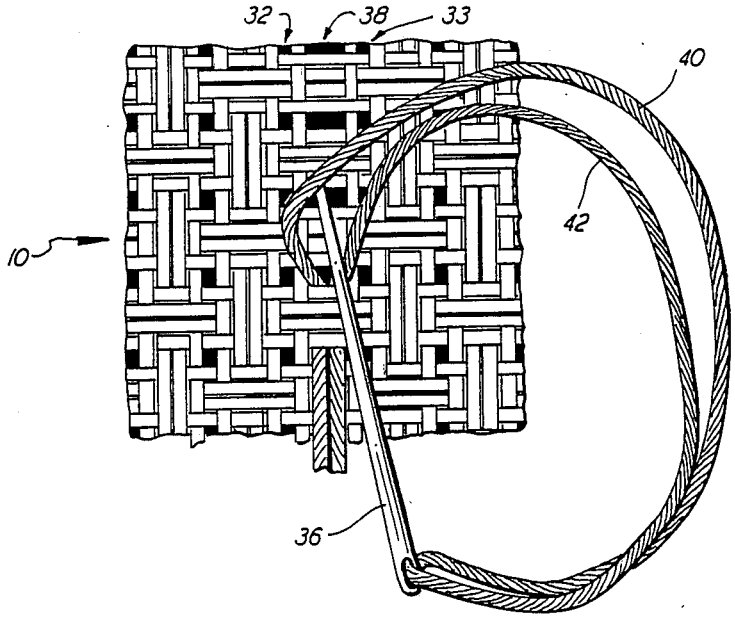
FIG. 4 is a front view of the fabric of FIG. 3, and illustrating a preferred method of passing the needle through the fabric relative to the thread when using a two-strand pattern thread.

Although the pattern thread is shown in FIGS. 3 and 4 as being placed in a column of openings which has been formed by removal of float threads, the first column of the pattern will often be placed in one of the previously existing columns of openings, e.g., 32 or 33. A column of openings formed by removing double floats, such as column 38, will be somewhat wider than the rows of existing openings, but this will not have a noticeable effect on the appearance of the finished design which normally includes pattern threads drawn through both previously existing and newly formed columns or rows of openings in the base fabric.

It is usually recommended that the pattern thread be worked into the fabric in the horizontal direction, from right to left, for right handed individuals, and that the first row to be worked is the horizontal row farthest from the center of the fabric. It is also recommended that floats be removed from only one or two rows or columns, and the pattern thread worked into that portion of the design before removing additional floats for easier visual perception of the rows being worked.

Figure 5:
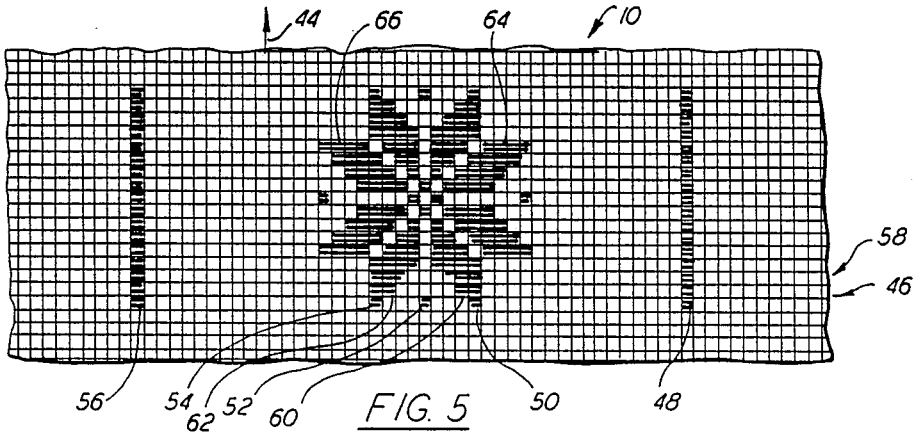
FIG. 5 is a front view of the fabric of FIG. 4 with a single pattern completed.

A completed design on the front side of base fabric 10 is illustrated in FIG. 5. The center of base fabric 10 is in the direction indicated by arrow 44. Preferably, row 46 is the first row formed by passing the needle and drawing the pattern thread through a row of original openings, in this design by passing the pattern threads over single thread groups, i.e., upwardly through one opening and downwardly through the next, successive opening, to form stitches 48, 50, 52, 54 and 56 in row 46. The next row 58 is then worked into a row of openings formed by removal of floating threads, with portions 60 and 62 formed by passing the pattern thread over two thread groups, i.e., by passing the needle upwardly through a preselected opening and downwardly through the second succeeding opening in the same row. Other stitches are formed by passing the pattern thread over, for example, four thread groups, as in stitches 64 and 66.

Figure 6:
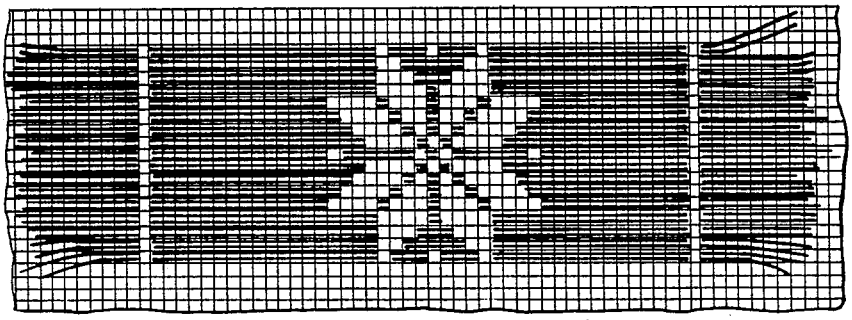
FIG. 6 is a rear view of the fabric with the completed pattern of FIG. 5.

The design shown in FIG. 5 is considered the front side of fabric 10, the reverse side being shown in FIG. 6. In some designs, the appearance may be equally attractive on either side of the fabric. Preferably, the pattern thread is not knotted and is allowed to extend from the base fabric for an inch or two at each end as the individual rows are formed. As previously mentioned, the edges including the pattern threads may be hemmed by machine, or hem stitched, and trimmed as desired.

The design illustrated in FIGS. 4 and 5 is formed by removing float threads from the entire rows in which pattern threads are to be placed. It is also within the scope of the invention to remove only portions of the float threads from the rows in which the pattern threads will be placed. In such cases, the float threads are cut at first and second positions intermediate of the ends and only the intermediate portions of the floats, in the area where the design is to be placed, are removed. For example, in the design of FIG. 4, if only the floral portion is to form the design (and not the border portions including stitches 48 and 56), only the portions of the float threads in the first (bottom) row from the right side of stitch 50 to the left side of stitch 54 need be removed. Likewise, only the intermediate portions of float threads in succeeding rows where pattern threads will be placed need be removed. Alternatively, intermediate include pattern threads may be removed between the extreme right and left sides of the design. That is, intermediate portions of floats would be removed from all horizontally extending thread groups which are to include pattern threads between the columns at the right side of stitch 64 and the left side of stitch 66.

What is claimed is:

1. A method of hand-forming needlework patterns conforming to a predetermined design on an even-weave base fabric of the type having orthogonal warp and weft threads arranged in thread groups, each of said groups being of uniform height and width and spaced from adjacent thread groups by equal distances whereby the common spaces at the corners of said thread groups form columns and rows of spaced, original openings extending in orthogonal directions in said base fabric, each of said thread groups including at least one warp and one weft float thread, all of said float threads passing over and under all threads of successive thread groups, all of said float threads being accessible from both sides of said base fabric and each of said thread groups including at least one outer thread on both sides of said float threads, said method comprising the steps of:

(a) removing from said base fabric at least those portions of said float threads lying within the peripheral limits of said predetermined design from each of a predetermined plurality of said thread groups in only one of said orthogonal directions, leaving intact all threads in said one orthogonal direction other than said float threads, and leaving in place of the removed float threads columns and rows of spaced, additional openings in said predetermined plurality of thread groups;

(b) threading a needle with a pattern thread;

(c) passing said needle and drawing said pattern thread alternately in upward and downward directions through predetermined ones of said original and/or said additional openings according to said predetermined design along a first row of said openings in said only one of said orthogonal directions between initial and terminal openings in said first row, forming therein a predetermined succession of stitches; and (d) thereafter passing said needle and drawing said pattern thread alternately in upward and downward directions through predetermined ones of said original and/or said additional openings according to said predetermined design along other rows of said openings, all of said other rows being parallel to said one row, between initial and terminal openings in each of said other rows.

2. The needlework method of claim 1 wherein each of said thread groups includes two float threads, both of which are removed from said plurality of thread groups.

3. The needlework method of claim 1 wherein said base fabric is aida cloth.

4. The needlework method of claim 3, wherein said pattern thread comprises two strands of embroidery floss.

5. The needlework method of claim 4 and including the further step of passing said needle between said strands of said pattern thread before each pass of said needle through said base fabric in at least one direction.

6. The needlework method of claim 1 wherein each of said thread groups includes a single float thread.

7. The needlework method of claim 6 wherein said pattern thread consists of two strands of pearl cotton.

8. The needlework method of claim 1 wherein at least one of said first row and said other rows of said openings is said row of additional openings.

9. The needlework method of claim 1 wherein all of said float thread which are removed from said base fabric are entirely removed from all rows in which said pattern thread is to be placed.

10. The needlework method of claim 1 wherein only intermediate portions of said float threads are removed from those portions of said rows wherein said predetermined design is formed.

* * * * *